United States Patent [19]

Fenn et al.

[11] 4,173,385

[45] Nov. 6, 1979

[54] WATERTIGHT CABLE CONNECTOR

[75] Inventors: John W. Fenn, Agincourt; James R. Stokes, Bowmanville, both of Canada

[73] Assignee: Bunker Ramo Corporation, Oak Brook, Ill.

[21] Appl. No.: 898,276

[22] Filed: Apr. 20, 1978

[51] Int. Cl.[2] ..... H01R 13/34; H01R 13/54

[52] U.S. Cl. ..... 339/177 E; 339/89 C; 339/94 C

[58] Field of Search ..... 339/177 R, 177 E, 89 C, 339/90 C, 94 R, 94 M, 94 C

[56] References Cited

U.S. PATENT DOCUMENTS

| | | | |
|---|---|---|---|
| 3,196,382 | 7/1965 | Morello | 339/177 R |
| 3,474,391 | 10/1969 | Gartzke et al. | 339/103 |
| 3,634,815 | 1/1971 | Steuens et al. | 339/177 E |
| 3,646,502 | 2/1972 | Hutter et al. | 339/89 C |
| 3,683,320 | 8/1972 | Woods et al. | 339/177 E |
| 3,686,623 | 8/1972 | Nijman | 339/177 E |
| 3,742,426 | 6/1963 | Huber et al. | 339/177 R X |
| 3,778,535 | 12/1973 | Forney | 339/89 C X |
| 3,810,076 | 5/1974 | Hutter | 339/177 R |
| 3,824,686 | 7/1974 | Forney | 29/628 |
| 3,854,789 | 12/1974 | Kaplan | 339/177 R |
| 3,930,705 | 1/1976 | Gallagher | 339/59 M |
| 3,953,099 | 4/1976 | Wilson | 339/60 M |

*Primary Examiner*—E. F. Desmond

*Attorney, Agent, or Firm*—William Lohff; F. M. Arbuckle

[57] ABSTRACT

An environmentally protected connector assembly for terminating a coaxial cable includes a tubular stem insertable between the braided outer conductor and inner insulation of the cable and fixedly carrying a collar and rotatably carrying a coupling nut for connection to a compatible connector component. O-rings provide seals between the coupling nut and the compatible connector and the collar. A resilient sleeve is received over the cable and includes inner ribs adjacent to one end to provide a watertight seal with the cable and having at the other end a lip engaging a flange on the collar to provide a further watertight seal. A retaining shoulder in the sleeve cooperates with an enlarged portion of the insertion end of the stem to retain the sleeve in place and provide further sealing. A crimp ferrule around the cable serves to clamp it on the connector stem.

11 Claims, 3 Drawing Figures

WATERTIGHT CABLE CONNECTOR

BACKGROUND OF THE INVENTION

The present invention relates to a connector assembly for coaxial cable and, in particular, to an environmentally sealed connector assembly adapted for use in outdoor applications where the cable and the connector assembly are exposed to the elements. A typical application would be in connecting the lead-in cable of a cable TV system to a subscriber jack fixture.

A great variety of electrical connectors and connector assemblies are known for terminating coaxial cable. These connectors and assemblies have been developed in response to the ever increasing demands made in the communications industry for reliable and low cost connectors which maintain high quality electrical interconnections.

One persistent problem, highlighted by the introduction of cable TV networks, is the need for a coaxial cable connector which satisfactorily seals the interior of the connector from the ambient environment. These connectors must withstand wide variations and rapid fluctuations in temperature and seal the connector from moisture, even when exposed to freeze and thaw cycles. Examples of prior art coaxial cable connectors useful or possibly useful in such applications are disclosed in U.S. Pat. Nos. 3,474,391; 3,646,502; 3,683,320; 3,686,623; and 3,810,076. Although these and other connectors and connector assemblies have met with some success, they suffer from the disadvantages of being constructed of numerous parts and being expensive to manufacture.

SUMMARY OF THE INVENTION

The present invention is directed toward an improved environmentally protected connector assembly for coaxial cable, which is characterized by relatively simple and economical construction, ease of assembly and the effective prevention of the intrusion of water or other deleterious substances to the interior of the connector.

More particularly, the connector assembly of the present invention provides means for securely fastening the connector assembly to the associated coaxial cable, and also provides a moisture-insulating sleeve or boot and means for securely retaining the boot in place on the connector assembly, all the while maintaining the desired low cost and required electrical characteristics of the connector.

The present invention is also directed to a coaxial cable connector assembly having an outer sleeve or boot which includes means for improving its sealing properties while at the same time preventing movement of the sleeve axially of the associated cable.

Further features of the invention pertain to the particular arrangement of the component parts of the connector assembly whereby the above-outlined and additional operating features are attained.

Accordingly, the present invention generally comprises a coaxial cable connector assembly having a tubular stem for mechanically retaining the cable and electrically engaging its outer conductor; an annular collar and a rotatable coupling nut are mounted on the stem; and sealing means cooperates with each of these elements for insulating the interior of the connector from the ambient environment.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

DESCRIPTION OF THE PREFERRED EMBODIMENT

Figure 3:
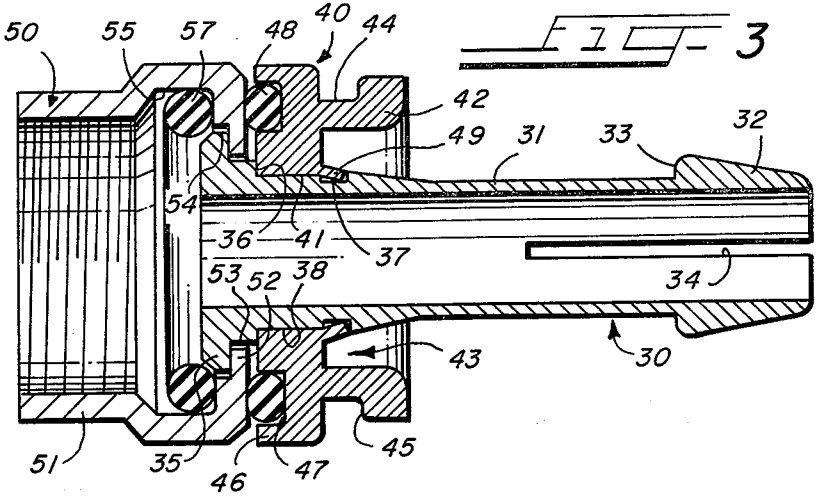
FIG. 3 is a view, similar to FIG. 2, showing a portion of the connector assembly only, disassociated from the coaxial cable and the compatible connector component.
Figure 1:
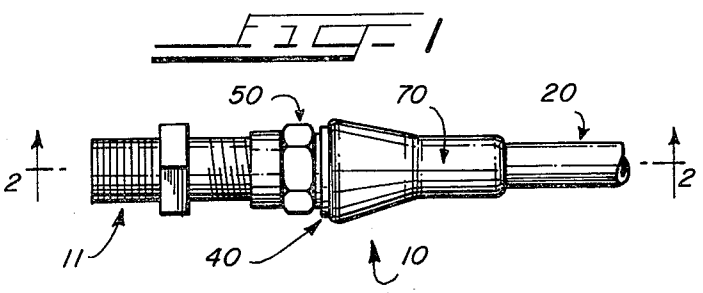
FIG. 1 is a side elevational view of the connector assembly constructed in accordance with and embodying the features of the present invention, illustrated in operation effecting a connection between a coaxial cable and a compatible connector component.
Figure 2:
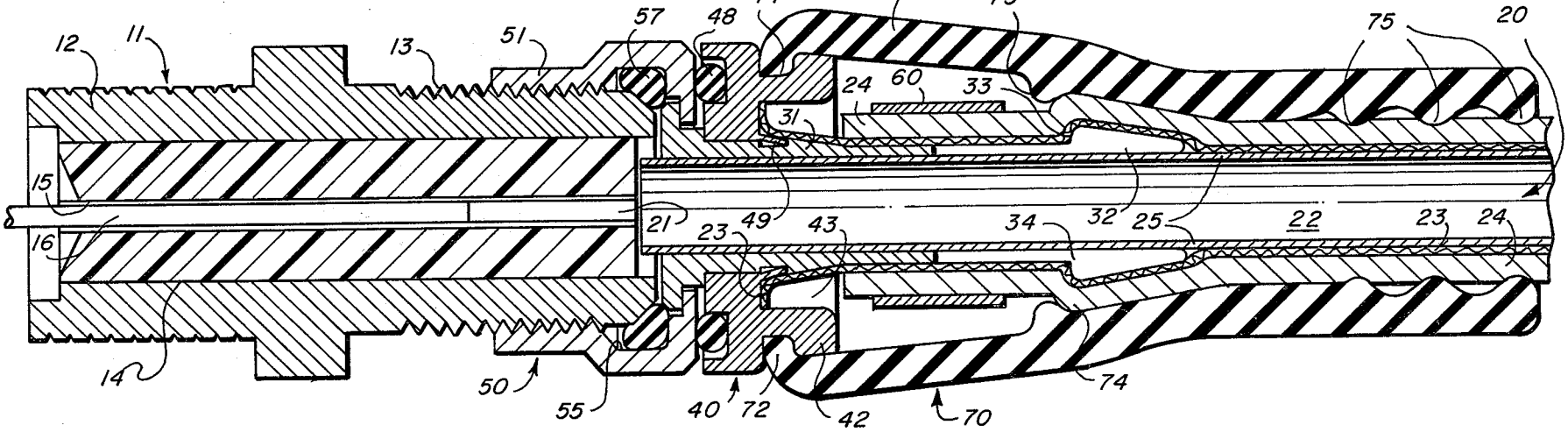
FIG. 2 is an enlarged view in vertical section taken along line 2—2 in FIG. 1.

Referring now more particularly to FIGS. 1 through 3 of the drawings, there is illustrated a connector assembly, designated generally by the numeral 10, for providing an environmentally protected interconnection between a compatible connector component, designated generally by the numeral 11, and a coaxial cable, designated generally by the numeral 20. The connector component 11 includes a conductive shell 12 externally threaded at one end 13 and having received coaxially therein an electrically insulating core 14 having a cylindrical bore 15 extending axially therethrough for receiving therein an inner conductor 16 which preferably terminates a predetermined short distance from the outer end of the threaded portion 13 of the shell 12.

The coaxial cable 20 is of standard construction and includes an inner conductor 21 encapsulated by a solid body of insulating material 22, which is in turn surrounded by a layer of aluminum foil 25 which in turn is surrounded by a braided outer conductor 23, the entire assembly being encased in an outer insulating layer or jacket 24.

The connector assembly 10 includes a connector stem, designated generally by the numeral 30, which has an elongated tubular body 31 having a terminal end 32 which is generally wedge-shaped in longitudinal transverse cross section to define an enlarged diameter shoulder 33 disposed inwardly from the terminus thereof. A plurality of slots 34, two in number, extend longitudinally from the terminal end 32 of the tubular body 31 and are spaced circumferentially thereon. The stem 30 is provided at the other or mating end with a radially outwardly extending annular retaining flange 35 and with an enlarged diameter annular stop shoulder 36. Spaced from the stop shoulder 36 toward the terminal end of the stem 30 is an annular groove 37, which is separated from the stop shoulder 36 by a generally cylindrical outer mounting surface 38. Surface 38 is preferably knurled and may have one or more flats formed thereon for reasons later explained.

The connector assembly 10 also includes an annular collar, designated generally by the numeral 40, which is provided with an inner, generally cylindrical surface 41 dimensioned for complementary mating engagement with the knurled surface 38 of the connector stem 30 to inhibit rotation of one with respect to the other alternatively, the collar 40 may have flats mating to those on the stem 30 for the same purpose.

The collar 40 includes a retaining flange 42 which extends axially of the collar 40 toward the terminal end of the connector assembly and cooperates with the stem 30 to define an annular recess 43. The outer surface of the retaining flange 42 includes an annular groove 44 which defines a shoulder 45 for a purpose to be described more fully below. The collar 40 is provided with a surface 46 which abuts the stop shoulder 36 of the connector stem 30 and includes an annular recess 47 dimensioned to receive an elastomeric seal such as O-ring 48. The collar 40 is also provided with an annular locking flange 49, which extends toward the terminal end of the connector assembly and is adapted to engage the groove 37 in stem 30.

The connector further includes a coupling nut, generally designated by the numeral 50, having an internally threaded body 51 adapted for engagement with the threaded portion 13 of the connector component 11. The body 51 includes end wall 52 provided with a circular aperture 53 having a diameter slightly greater than the outer diameter of the stop shoulder 36 of the connector stem 30. Formed on the inner surface of the end wall 52 is an annular recess 54 having a diameter only slightly greater than the outer diameter of the retaining flange 35 of the connector stem 30. The cylindrical body 51 also includes an enlarged-diameter annular recess 55 dimensioned for retaining therein an associated O-ring 57.

Preferably, the connector stem 30, the collar 40 and the coupling nut 50 are assembled into a subassembly illustrated in FIG. 3, in the manner which will now be described. First, the insertion end of the connector stem 30 is inserted through the aperture 53 in the coupling nut end wall 52 in a left-to-right direction, as illustrated in FIG. 3, until the retaining flange 35 is seated in the annular recess 54 of the coupling nut 50. Next, the O-ring 48 is inserted into the annular recess 47 of the collar 40, preferably after prior insertion of silicone grease into the recess 47. Then the collar 40, with the O-ring 48 in place, is fitted over the terminal end of the connector stem 30 and onto the knurled mounting surface 38 of the connector stem 30 until the surface 46 abuts against the stop surface 36. The locking flange 49 is so dimensioned that as the surface 46 engages the stop shoulder 36, the locking flange 49 may be deflected into the groove 37 to preclude axial movement of the collar 40 relative to the connector stem 30. The mating knurled surfaces 38 and bore 41 of the connector stem 30 and collar 40 cooperate to prevent rotation of one relative to the other. When the collar 40 is thus mounted in place, the O-ring 48 will engage the end wall 52 of the coupling nut 50, thereby effectively retaining the O-ring 48 in place. Finally, the O-ring 57 is inserted into the recess 55 of the coupling nut 50.

The connector assembly 10 further includes a crimp ferrule 60 (FIG. 2) to be used in the manner described below, and a sealing sleeve or boot, generally designated by the numeral 70, formed of a waterproof elastomeric material. The sleeve 70 is generally cylindrical and is provided adjacent to one end with an outwardly flared portion 71 which terminates in a radially inwardly extending annular lip 72. Formed adjacent to the other end of the flared portion 71 and extending radially inwardly is an annular latching shoulder 73. Formed adjacent to the other end of the sleeve 70 and spaced apart longitudinally thereof are three radially inwardly extending annular sealing ribs 75, the inner diameters of which are less than the outer diameter of the insulating jacket 24 of the associated coaxial cable 20.

The termination of the coaxial cable 20 to the connector assembly 10 will now be described. Initially, the free end of the cable 20 is cut to the desired length and then the sleeve 70 and crimp ferrule 60 are slid over the cable 20 and pushed back away from the free end. The cable 20 is then stripped to its inner conductor 21 to expose a length of inner conductor 21 which is substantially equal to the distance between the inner conductor 16 of the connector component 11 and the threaded end thereof. Then the insulation jacket 24 of the cable 20 is stripped to the braided outer conductor 23 to expose a predetermined length thereof approximately equal to the axial distance between the mating end of the connector stem 30 and the distal end of the collar retaining flange 42.

The terminal end of the tubular body 31 of the connector stem 30 then is inserted between the outer conductor or braid 23 and the foil covered insulating body 22 of the coaxial cable 20. The inner diameter of the tubular body 31 is substantially the same as the outer diameter of the aluminum foil 25 that surrounds the body 22 to accommodate this insertion. The insertion of stem 30 is facilitated by the wedge-shape of the tip 32 of the connector stem 30 and the flexibility of the insertion end afforded by the slots 34. The insertion continues until the free end of the cable inner conductor 21 extends from the mating end of the connector and the free end of the outer insulating layer 24 is adjacent to the collar retaining flange 42, the free end of the outer braid conductor 23 being forced into the annular recess 43. Preferably, during this insertion, the cable 20 is rotated in a circular motion to flare the free end of the outer braid conductor 23 to facilitate its riding up and inside the annular recess 43. However, the free end of the outer braid conductor 23 is captured within the recess 43 and cannot flair out and interfere with the proper seating and sealing of the sleeve 70. The enlarged diameter of the tip 32 produces a slight bulge 74 in the outer braid conductor 23 and insulating jacket 24 of the cable 20.

The crimp ferrule 60 is then slid back along the cable 20 toward the free end until it is disposed between the free end of the cable insulating jacket 24 and the bulge 74, at which position the ferrule 60 is crimped in place, as illustrated in FIG. 2, to thereby hold the connector stem 30 and coaxial cable 20 assembled together. Finally, the sleeve 70 is slid back along the cable 20 until the latching shoulder 73 rides over and engages in front of the bulge 74, at which point the annular lip 72 is inserted into the groove 44 of the collar 40 for cooperation with the shoulder 45 to retain the sleeve 70 in place and provide an environmental seal between the collar flange 42 and the sleeve lip 72.

When the connector assembly 10 is thus assembled with the associated coaxial cable 20, it will be appreciated that the latching shoulder 73 cooperates with the shoulder 33 of the connector stem 30 and with the bulge 74 formed thereby in the cable outer insulating layer 24 for retaining the sleeve 70 in place and providing an additional seal between the sleeve 70 and the cable 20. Further, the ribs 75 of the sleeve 70 engage the outer insulating layer 24 of the cable 20 to provide still another seal therebetween.

When the coupling nut 50 is then threadedly engaged with the connector component 11, the flange 35 engages the outer shell 12 of the connector 11, and the O-ring 57 is compressed between the outer shell 12, the groove wall 55 of the coupling nut 50 and the retaining flange 35 of the connector stem 30. This arrangement provides an effective seal and further drives the coupling nut 50 more securely into engagement with the O-ring 48 to provide an even tighter seal between the coupling nut 50 and the collar 40.

Each of the principal structural components of the connector, the stem 30, collar 40 and nut 50, may be fabricated by die casting a suitably corrosion resistant metal, such as zinc. In addition, these parts may likewise be plated to further enhance their anti-corrosion properties. The sealing elements, namely sleeve 70 and the O-rings 48 and 57, can be molded from any of a number of well known natural or synthetic rubbers or elastomeric materials.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. An electrical connector assembly for terminating a coaxial cable including inner and outer conductors, an insulating member separating said conductors and an outer insulating layer covering the outer conductor, said connector assembly comprising:

a tubular conductive connector stem having a terminal end and a mating end and dimensioned to be mounted coaxially over the insulating member of the associated cable with said terminal end disposed between the insulating member and the outer conductor of the associated cable;

an annular collar diposed coaxially about said stem and having an annular retaining flange extending therefrom;

an outer sleeve having an annular lip at one end, said sleeve being mounted coaxially about the associated cable in sealing engagement therewith, and said lip resiliently engaging said annular retaining flange in sealing relationship;

a coupling nut rotatably carried by the mating end of said stem adjacent to said collar for coupling to a compatible connector component;

first annular seal means disposed between said coupling nut and said collar in sealing engagement with each; and second annular seal means disposable between said coupling nut and the compatible connector component for sealing engagement with each.

2. The connector assembly of claim 1, and further including compression means disposed coaxially over the outer insulating layer of the associated cable coincident with the terminal end of said stem to securely clamp said cable to said stem.

3. The connector assembly of claim 1, wherein said stem includes a plurality of longitudinally extending slots at said terminal end.

4. The connector assembly of claim 1, wherein said retaining flange includes an annular groove and shoulder, said sleeve lip cooperating with said groove and shoulder to facilitate retention of said sleeve in the sealing relationship with said collar.

5. The connector assembly of claim 1, wherein said collar includes means cooperating with said coupling nut for retaining said first annular seal means in place.

6. The connector assembly of claim 1, wherein said retaining flange is disposed for cooperation with said connector stem for defining therebetween an annular recess to receive the distal end of the outer conductor of the associated cable when said connector stem is disposed in its mounted configuration.

7. The connector assembly of claim 1, wherein said collar and said stem include complementary surfaces disposed in mating engagement to prevent relative rotational movement between said collar and said stem.

8. The connector assembly of claim 1, further including latch means for preventing movement of said collar axially of said connector stem.

9. The connector assembly of claim 1, wherein said connector stem has a cylindrical mounting surface and a radially outwardly extending stop shoulder at one end of said mounting surface and a radially inwardly extending annular groove at the other end of said mounting surface, said collar being disposed coaxially about said mounting surface in engagement therewith and against said stop shoulder and having a flange receivable in said annular groove for cooperation with said stop shoulder to prevent movement of said collar axially of said connector stem.

10. An electrical connector assembly for terminating a coaxial cable including an inner conductor and an outer conductor, an insulating member separating said conductors, and an outer insulating layer covering the outer conductor, said connector assembly comprising:

a tubular conductive connector stem having a terminal end including an enlarged diameter portion and a mating end, said stem disposed coaxially about the insulating member of the associated cable with said terminal end disposed between the insulating member and the outer conductor of the associated cable;

an annular collar disposed coaxially about said tubular connector stem and fixedly coupled thereto and having an annular retaining flange extending therefrom;

an outer elastomeric sleeve having an annular lip at one end, said sleeve being coaxially mounted about the associated cable in sealing engagement therewith and said lip resiliently engaging said annular retaining flange in sealing relationship;

said sleeve having an annular retaining shoulder extending radially inwardly therefrom and cooperating with said enlarged diameter portion of said terminal end of said stem for holding said sleeve in its sealing relationship with said flange and providing a further seal between said sleeve and the associated cable;

a coupling nut rotatably carried by said stem and adjacent to said collar for coupling to a compatible connector component;

first annular seal means disposed between said coupling nut and said collar in sealing engagement with each, and second annular seal means disposable between said coupling nut and the compatible connector component for sealing engagement with each.

11. The connector assembly of claim 10, wherein said sleeve has a plurality of radially inwardly extending annular ribs adjacent to the other end thereof dimensioned to provide a compression fit about the outer insulating layer of the associated cable for enhancing the seal therebetween.

* * * * *